United States Patent [19]

Gesy

[11] Patent Number: 4,880,046

[45] Date of Patent: Nov. 14, 1989

[54] DOOR SEALING APPARATUS

[76] Inventor: Jerry Gesy, R.R. #1, Lime Springs, Iowa 52155

[21] Appl. No.: 248,991

[22] Filed: Sep. 26, 1988

[51] Int. Cl.[4] ..... E05D 15/16

[52] U.S. Cl. ..... 160/194; 160/201; 160/40; 49/212

[58] Field of Search ..... 160/194, 201, 40, 41, 160/42, 43, 195, 188, 189; 49/212; 16/94 R, 96 R

[56] References Cited

U.S. PATENT DOCUMENTS

| | | | |
|---|---|---|---|
| 1,724,995 | 8/1929 | Dautrick . | |
| 2,064,470 | 12/1936 | Heckman | 16/94 R |
| 2,189,019 | 2/1940 | Rowe . | |
| 2,228,361 | 1/1941 | O'Neil . | |
| 2,309,437 | 1/1943 | Blodgett . | |
| 2,749,582 | 6/1956 | Beck | 160/40 |
| 2,837,151 | 6/1958 | Stroup | 160/40 |
| 2,855,989 | 10/1958 | Pritchard | 160/40 |
| 3,034,575 | 5/1962 | Stroup | 160/40 |
| 3,331,158 | 7/1967 | Frakes | 160/40 X |
| 3,389,740 | 6/1968 | Buehler | 160/188 |
| 3,412,507 | 11/1968 | Sterner | 49/212 |
| 4,320,793 | 3/1982 | Lindbergh | 160/194 X |
| 4,480,863 | 11/1984 | Hormann . | |

*Primary Examiner*—Ramon S. Britts
*Assistant Examiner*—David M. Purol
*Attorney, Agent, or Firm*—Leon Gilden

[57] ABSTRACT

The present invention sets forth a garage door sealing apparatus wherein a plurality of electric motors are integrally secured to each door track of a typical garage reciprocating door. Upon closing of the door, the plurality of electric motors each pull the associated track into engagement with the framework of the garage and wherein movement is halted upon the associated door contacting at least one limit switch. This arrangement pulls the garage door into sealing engagement with the associated framework to minimize heat loss through a garage.

1 Claim, 3 Drawing Sheets

DOOR SEALING APPARATUS

BACKGROUND OF THE INVENTION

1. Field of the Invention

The field of the invention relates to garage doors, and more particularly pertains to a new and improved door sealing apparatus that accommodates wear within seals of a garage door to framework arrangement to maintain a sealing arrangement therebetween limiting heat loss from the garage to an exterior environment.

2. Description of the Prior Art

In contemporary construction, garages are typically formed as part of the dwelling of the house to avoid the traditional walk from the house to a detached garage during inclement weather. In an energy conscious society, heat loses through garage doors that are lacking in appropriate sealing engagement with a surround framework have proven to be unacceptable. Garage doors of the prior art have only nominally been concerned with sealing and while this has been a consideration, there has heretofore not been an affective organization to properly provide a mechanical arrangement to accommodate seal wear to enable a garage door to properly sealingly interfit with the framework.

For example, U.S. Pat. No. 4,480,863 to Hormann sets forth a latch assembly for use in combination with a garage door and the like to properly secure a garage door to an associated track, but as is typically of prior art arrangements, the energy loss through the garage door subsequent to latching is of a secondary consideration.

U.S. Pat. No. 2,309,437 to Blodgett sets forth an adjustable bearing for use with garage door locking bolts to accommodate wear within the locking arrangement. While of interest relative to garage door attaching members, the Blodgett patent does not set forth a means to accommodate wear within a sealing arrangement in a garage door to framework relationship.

U.S. Pat. No. 2,228,361 to O'Neil sets forth another example of a garage door and lock to securedly maintain a garage door in contiguous relationship to a framework. The O'Neil patent, as is typical of the other prior art patents, does not set forth a means of accommodating a seal in its wear pattern in association with a garage door framework.

U.S. Pat. No. 2,189,019 to Rowe sets forth a further example of a typical overhead reciprocating garage door formed with a plurality of tracks and rollers slidable within said tracks for maintaining orientation of the garage door relative to an associated framework. The Rowe patent utilizes means for effecting lateral movement of the door and panels into a sealing engagement with the door jambs after the panels reach a fully downward position. The mechanism utilized resiliently enhanced latch bars to effect a lock and sealing association of the door with respect to a door jamb.

U.S. Pat. No. 1,724,995 to Dautrick sets forth a garage door wherein lowering of the door will force the door into abutment with a door casing to ensure a sealing engagement therewith by the use of typical rollers and the like associated within a track work to effect such engagement.

As such, it may be appreciated that there is a continuing need for a new and improved door sealing apparatus wherein the same effectively and repeatedly sealingly secures a garage door in operative engagement with an associated garage door framework.

SUMMARY OF THE INVENTION

In view of the foregoing disadvantages inherent in the known types of garage door sealing apparatus now present in the prior art, the present invention provides a door sealing apparatus wherein the same includes plural pairs of motors operative through gear boxes to release and secure a garage door relative to a framework upon respective opening and closing of the door. As such, the general purpose of the present invention, which will be described subsequently in greater detail, is to provide a new and improved door sealing apparatus which has all the advantages of the prior art garage door apparatus and none of the disadvantages.

To attain this, the present invention includes a plurality of motors secured to the guide rails of the garage door organization to draw the garage door tracks in proximity to the garage door framework upon closure of the garage door and upon the garage door contacting an associated limit switch, motion of the garage door is halted. Optionally the garage door track may be slidingly secured relative to the garage floor and overlying track securement system to ease the sliding relationship of the garage door track relative to the garage door framework.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a base is for the designing of other structures, methods and systems for carrying out the several purposes of the present invention. It is important, therefore, that the claims be regarded as including such equivalent construction insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved door sealing apparatus which has all the advantages of the prior art door sealing apparatus and none of the disadvantages.

It is another object of the present invention to provide a new and improved door sealing apparatus which may be easily and efficiently manufactured and marketed.

It is a further object of the present invention to provide a new and improved door sealing apparatus which is of a durable and reliable construction.

An even further object of the present invention is to provide a new and improved door sealing apparatus which is susceptible of a low cost of manufacture with regard to both materials and labor, and which accordingly is then susceptible of low prices of sale to the consuming public, thereby making such door sealing apparatus economically available to the buying public.

Still yet another object of the present invention is to provide a new and improved door sealing apparatus which provides in the apparatuses and methods of the prior art some of the advantages thereof, while simultaneously overcoming some of the disadvantages normally associated therewith.

Still another object of the present invention is to provide a new and improved door sealing apparatus wherein the same utilizes gear reduction motors to secure a reciprocating door in closer proximity to a framework to effect sealing relationship between the door and framework.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
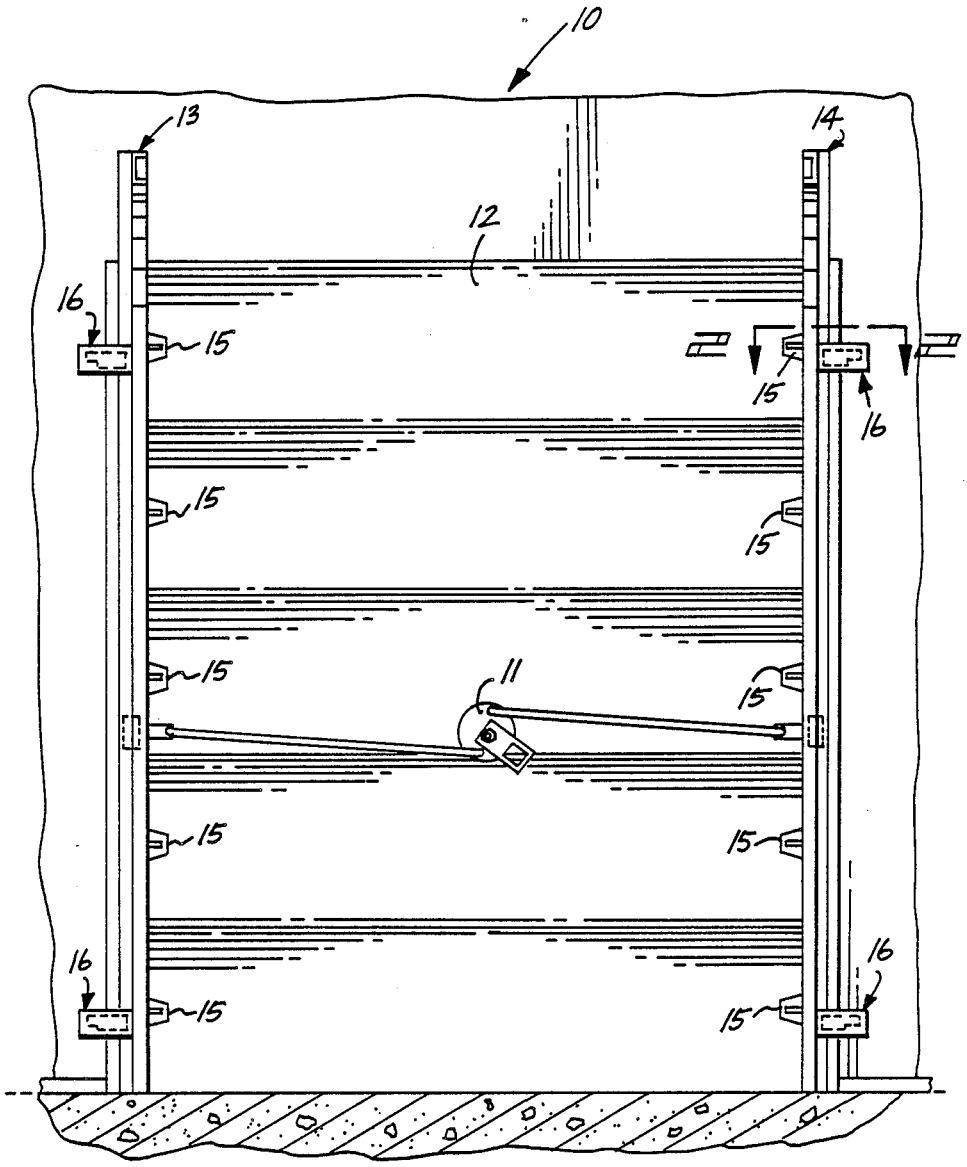
FIG. 1 is an orthographic view taken in elevation illustrating a garage door and track system of the instant invention.
Figure 2:
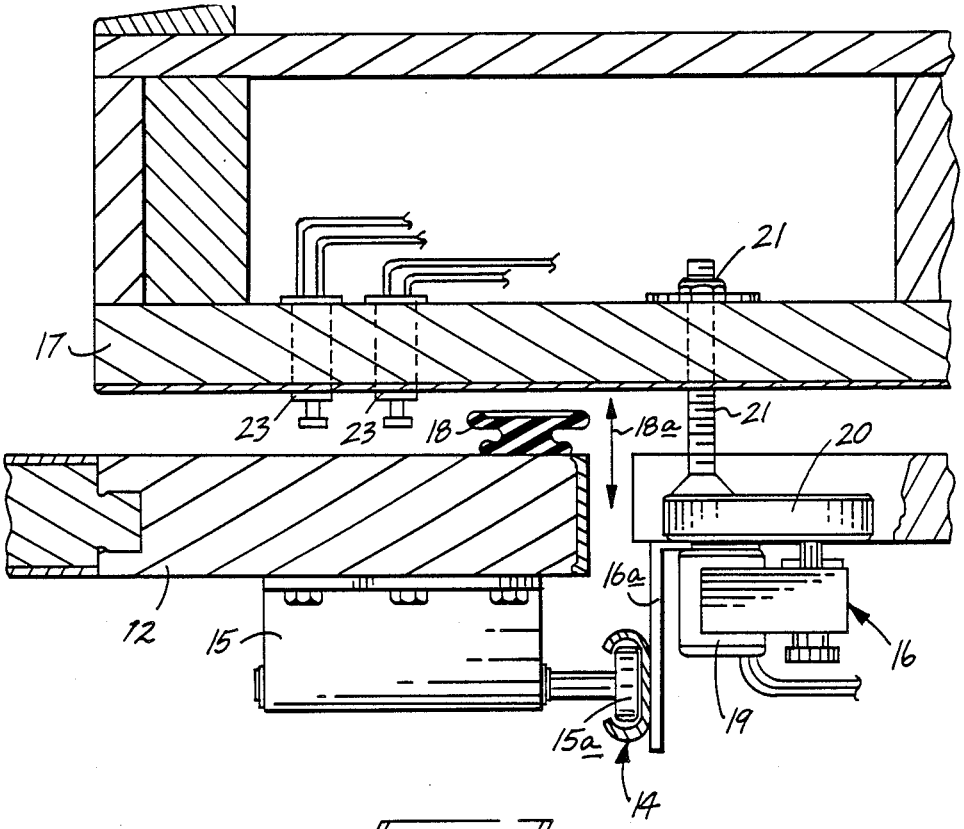
FIG. 2 is an orthographic view taken along the lines 2—2 of FIG. 1 in the direction indicated by the arrows.
Figure 3:
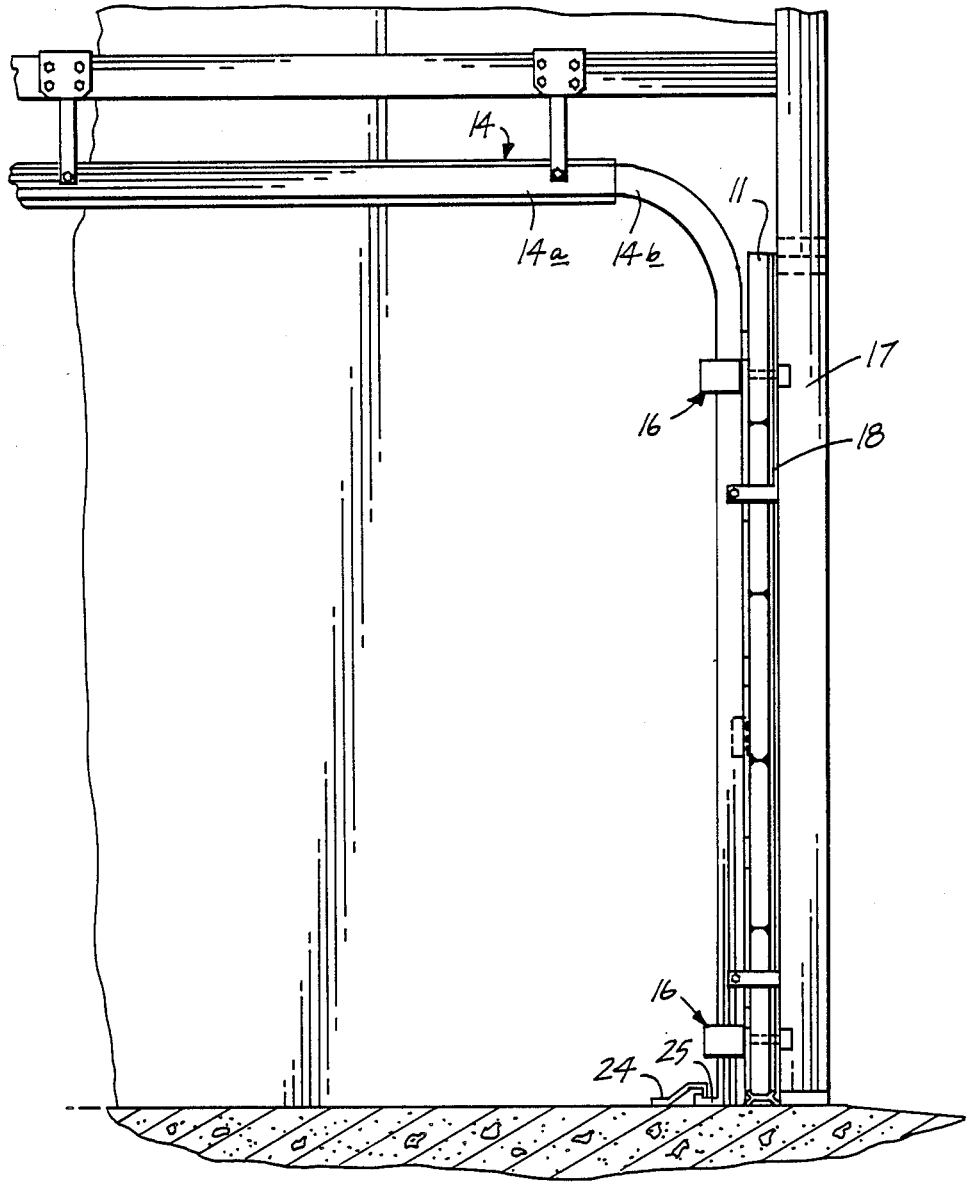
FIG. 3 is an orthographic side view taken in elevation of the invention.

With reference now to the drawings, and in particular to FIGS. 1 to 3 thereof, a new and improved door sealing apparatus embodying the principles and concepts of the present invention and generally designated by the reference numeral 10 will be described.

More particularly, it will be noted that the door sealing apparatus 10 essentially comprises a garage door 12 formed with a conventional latch mechanism 11 to be received within appropriate recesses within the first track 13 and the second track 14 respectively.

Formed on a rear surface of the door 11 are plural series of support roller brackets 15 securing respective support rollers 15a (as illustrated in FIG. 2 for example) for alignment and rolling interengagement of the door 11 with the first and second respective tracks 13 and 14.

Plural pairs of actuation electric motors 16 are secured to the respective first and second tracks 13 and 14 by motor securement brackets 16a, as illustrated in FIG. 2. The door framework 17 in proximity to the garage door 11 is brought into interengagment therewith by employment of the electric motors to effect contact of the elongate resilient seal 18 secured to the perimeter of the garage door 12 to engage a forward surface of the door framework 17. Reciprocation is effected along the arrow 18a, as illustrated in FIG. 2.

The actuation motor 16 include an electric motor 19 integrally and operatively secured through a gear reduction housing and associated gears 20 to a threaded output shaft 21 reversibly rotatable by means of the reversing electric motor 19. The threaded output shaft 21 is received within an internally threaded receiving nut 22 integrally secured within framework 17.

Limit switches 23 positioned on the framework 17 limit the forward motion of the door 12 by means of the actuation motor 16.

In use, upon opening of the door 12, the threaded output shaft 21 is rotated in a first direction to direct the door 12 outwardly from the framework 17 whereupon the door 12 is reciprocated upwardly along the respective tracks 13 and 14 in a conventional manner. Upon closing the garage door 12, the electric motor 19 is reversed whereupon the threaded output shaft 21 pulls the garage door 12 against the framework 17 whereupon the limit switches associated electrically with the output motor 9 in a conventional manner well known to those in the art, halts the motor 19 and effects sealing of the garage door 12 by means of the seal 18. It should be noted that a seal 18 is positioned adjacent each side of the door 12 to effect a more complete seal of the door relative to the framework 17.

To enhance the reciprocation of the door 11 relative to the framework 17, the tracks 13 and 14 may be telescopingly oriented, as illustrated in FIG. 3, whereupon an outward track 14a receives an inward track 14b therein at uppermost portion relative the door 11 with a receiving housing 24 receiving a guide pin 25. The guide pin 25 is integrally secured to the door while the receiving house 24 is integrally secured to the floor of the garage whereupon reciprocation of the door is more easily effected along the direction of the arrow 18a. There is inherent flexure within the tracks 13 and 14 to enable such reciprocation, but the use a telescoping track organization 14a and 14b and an associated and similar telescoping relationship within the first track 13a, as well as the use of reciprocation of the lowermost portion of the track, as illustrated in FIG. 3, will enhance the ability of the tracks 13 and 14 to reciprocate.

As to the manner of usage and operation of the instant invention, the same should be apparent from the above description and accordingly no further discussion relative to the manner of usage and operation will be provided provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and description, and accordingly, all suitable modifications and equivalents may be resorted to, falling within the scope of the invention.

What is claimed as being new and desired to be protected by Letters Patent of the United States is as follows:

1. A door sealing apparatus comprising, in combination, a reciprocating door vertically reciprocatable and slidably secured to a plurality of "L" shaped tracks, such "L" shaped tracks including a vertical portion and a horizontal portion where in said vertical portion said tracks are positioned proximate a door framework, and motor means secured to each of said tracks for positioning said tracks relative to said framework, and receiving means integrally secured to said framework for receiving a rotatable output shaft from said motor means to reposition said tracks relative to said framework, and wherein said motor means comprise a rotatable motor and said rotatable output shaft is externally threaded, and wherein said receiving means is internally threaded for receiving said rotatable output shaft for repositioning said door relative said framework, and wherein said motor means is operably associated with a gear reduction means for increasing torque to said rotatable output shaft wherein said rotatable output shaft is upwardly secured to said gear reduction means, and wherein at least one limit switch is positioned on said framework relative to said door limiting forward positioning of said door by said motor means, and wherein said door includes a plurality of elongate seals for engagement with said framework, and wherein said motor means is secured to said tracks by a bracket member, and wherein said motor means comprise a plurality of reversible motors secured to each of said tracks, and wherein said vertical portion of said track is telescoping receivable within a horizontal portion of said track, and each lowermost terminal end of said vertical track portion includes a pin receivable within a housing for guidingly receiving said track within said housing.

* * * * *